US005879002A

United States Patent [19]

Nakamura et al.

[11] Patent Number: 5,879,002

[45] Date of Patent: Mar. 9, 1999

[54] METHOD AND APPARATUS FOR FEEDING SHEETS FOR PREDETERMINED TIME WHICH IS CHANGEABLE BASED ON NUMBER OF SHEETS FED

[75] Inventors: Hidenobu Nakamura, Toyokawa; Koji Naito, Toyohashi; Yoshiaki Nakajima, Toyokawa, all of Japan

[73] Assignee: Minolta Co., Ltd., Osaka, Japan

[21] Appl. No.: 869,496

[22] Filed: Jun. 5, 1997

Related U.S. Application Data

[62] Division of Ser. No. 549,265, Oct. 27, 1995, Pat. No. 5,692,741, which is a division of Ser. No. 209,115, Mar. 9, 1994, Pat. No. 5,540,426.

[30] Foreign Application Priority Data

Mar. 10, 1993 [JP] Japan ..... 5-077570
Mar. 20, 1993 [JP] Japan ..... 5-085743

[51] Int. Cl.[6] ..... B65H 5/00

[52] U.S. Cl. ..... 271/10.11; 271/114; 271/264

[58] Field of Search ..... 271/258.01, 265.01, 271/114, 10.03, 10.11, 10.13, 10.12, 264

[56] References Cited

U.S. PATENT DOCUMENTS

| | | | |
|---|---|---|---|
| 4,809,969 | 3/1989 | Bastow et al. | 271/258 |
| 4,868,609 | 9/1989 | Nagata et al. | 355/316 |
| 5,112,038 | 5/1992 | Dunaway | 271/10 |
| 5,379,994 | 1/1995 | Kushida | 271/9 |
| 5,419,547 | 5/1995 | Jeong | 271/263 |
| 5,423,527 | 6/1995 | Tranquilla | 271/10 |
| 5,667,215 | 9/1997 | Yoshino | 271/258.01 |

FOREIGN PATENT DOCUMENTS

| | | |
|---|---|---|
| 61-51429 | 3/1986 | Japan . |
| 62-46839 | 2/1987 | Japan . |
| 62-136442 | 6/1987 | Japan . |
| 2-144348 | 6/1990 | Japan . |
| 2-158543 | 6/1990 | Japan . |
| 2-204239 | 8/1990 | Japan . |
| 2-282138 | 11/1990 | Japan . |
| 2-42677 | 11/1990 | Japan . |
| 3-267241 | 11/1991 | Japan . |
| 4-333453 | 11/1992 | Japan . |
| 5-338845 | 12/1992 | Japan . |
| 6-56309 | 3/1994 | Japan . |
| 6-263283 | 9/1994 | Japan . |

*Primary Examiner*—Boris Milef
*Attorney, Agent, or Firm*—Sidley & Austin

[57] ABSTRACT

In an operation for transporting a sheet by a first roller to a second roller pair downstream of the first roller, and further transporting the sheet by the second roller pair, a the time during which the sheet is transported by the first roller is controlled, responsive to the number of sheets which have been fed by the first roller, to suppress disadvantages such as jamming and deformation into a Z-form, which may be caused by reduction of a transporting performance due to wear of the rollers and adhesion of paper powder to the rollers.

13 Claims, 7 Drawing Sheets

METHOD AND APPARATUS FOR FEEDING SHEETS FOR PREDETERMINED TIME WHICH IS CHANGEABLE BASED ON NUMBER OF SHEETS FED

This is a division of application Ser. No. 08/549,265, filed Oct. 27, 1995 and now U.S. Pat. No. 5,692,741, which is a division of application Ser. No. 08/209,115, filed Mar. 9, 1994 and now U.S. Pat. No. 5,540,426. Each of these prior applications is incorporated herein by reference in their entirety.

BACKGROUND OF THE INVENTION

1. Field of the Invention

The present invention relates to a method of feeding sheets and a device for the same which are used in image forming apparatuses such as copying machines and printing machines. In particular, the invention relates to a method and a device for correcting a state wherein paper sheets cannot be transported at an intended speed due to wear caused by aging of a roller for transporting the sheets and/or due to adhesion of paper powder onto a surface of the roller.

2. Description of the Related Art

In a sheet transporting system of an image forming apparatus such as a copying machine, sheets are transported by a plurality of rollers such as feed roller, transporting roller, intermediate roller, timing roller, transporting roller and discharge roller. For this sheet transporting system, there have been proposed a method and a device in which initiative in transporting a sheet is changed from a roller at an upstream position, in view of a moving direction of the sheet, to a subsequent roller pair, i.e., downstream roller pair next to the upstream roller, in accordance with a timing at which a leading edge of the sheet, which is being transported by a transporting force of the upstream roller, is pinched at a nip of the subsequent roller pair. In connection with such method and device, there has been proposed such a structure that a one-way clutch operates to idle the upstream roller after the change of initiative in transporting sheets.

In the method and device for feeding sheets described above, however, the sheet cannot be transported by the downstream roller pair and thus stops, if the upstream roller is stopped before the leading edge of the sheet, which was being transported by the transporting force of the upstream roller, is pinched at the nip of the downstream roller pair. Thus, jamming of the sheet occurs. This situation, in which the upstream roller is stopped before the leading edge of the sheet is pinched at the nip of the downstream rollers, is caused, for example, by reduction of force for transporting the sheet due to the fact that slip is liable to generate because of wear caused by aging of the upstream roller and/or adhesion of paper powder.

Further, such a disadvantage may generate that the sheet slacks at a position between the upstream and downstream rollers and thereby bends, for example, into a Z-form, if the upstream roller, of which sheet transporting speed is relatively higher than that of the downstream roller, continuously applies the transporting force to the sheet even after the leading edge of the sheet is pinched at the nip of the downstream rollers and thereby the sheet starts to be transported by the transporting force of the downstream rollers. This situation, in which the upstream roller continuously applies the transporting force to the sheet even after the start of transportation of the sheet by the downstream rollers, is caused for example in the case where an excessively large margin for the transportation by the upstream roller is set in order to prevent the jamming. The situation, in which the transport speed of the downstream roller is lower than that of the upstream roller, is caused for example in such a case that slippage is liable to occur on the downstream roller due to wear caused by aging and/or due to adhesion of paper powder, which results in reduction of the sheet transporting ability of the downstream roller.

Even if the transport speed of the upstream roller reduces only to an extent that does not cause the serious problem described above, the sheet being transported may not reach a predetermined position (i.e., may not be detected at the predetermined position) within a predetermined time period, in which case the apparatus determines that the jamming has occurred and thus stops its operation. Here, the above "predetermined time period" is a time period which is enough for the sheet, which is transported at a set speed, to reach a "predetermined position".

In view of the above, there has been proposed a method and a device for transporting sheets, in which drive, i.e., rotation of the feed roller is stopped in accordance with the timing at which a sensor opposed to a downstream roller pair detects that the leading edge of the sheet fed from the feed roller at the upstream position reaches the downstream roller pair.

These method and device can overcome the foregoing disadvantages. However, these method and device require a complicated structure for attaching the sensor. It is difficult; to attach the sensor accurately to the nip portion of the downstream roller pair without a positional error.

SUMMARY OF THE INVENTION

Accordingly, it is a primary object of the invention to provide a method and a device for feeding sheets in which initiative in transporting a sheet changes from upstream transporting means to downstream transporting means in accordance with a timing at which a leading edge of the sheet is pinched by the downstream sheet transporting means, and particularly a method and a device which can suppress jamming and deformation into a Z-form of the sheet, which may be caused, for example, by wear of the transporting means due to aging and adhesion of paper powder, without requiring complicated mechanical structures relating to a position and a number of sensors and others.

The foregoing object of the invention can be achieved by the following method and device for transporting sheets.

A method of transporting sheets in which a sheet feed roller is driven to transport the sheet being in contact with the same for a predetermined time period, including the steps of counting a number of the sheets transported by the roller, and extending the predetermined time period to a second predetermined time period when a count exceeds a predetermined value: and A sheet feeding device including:

a roller for transporting a sheet being in contact with the same;

drive means for driving the roller to rotate;

a timer for restricting a drive time period for the drive means to a predetermined time period;

a counter for counting a number of sheets transported by the roller; and control means for controlling the predetermined time period of the timer to extend the same to a second predetermined time period when a count of the counter exceeds a predetermined value.

The roller may be a feed roller for sequentially feeding stacked sheets. The device may employ second transporting means located downstream and next to the roller, and the time period restricted by the timer may be substantially equal to a transport time period from start of transportation of the sheet by the roller to arrival of the sheet to the second transporting means.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

A practical example of a method and a device for feeding sheets according to the invention will be described below with reference to FIGS. 1 to 8. The sheet feeding method described below is implemented by a sheet feeding device in copying machine shown in FIG. 1.

[1] Structures of First Copying Machine

Description will first be made on structures of the copying machine equipped with the sheet feeding device.

Figure 1:
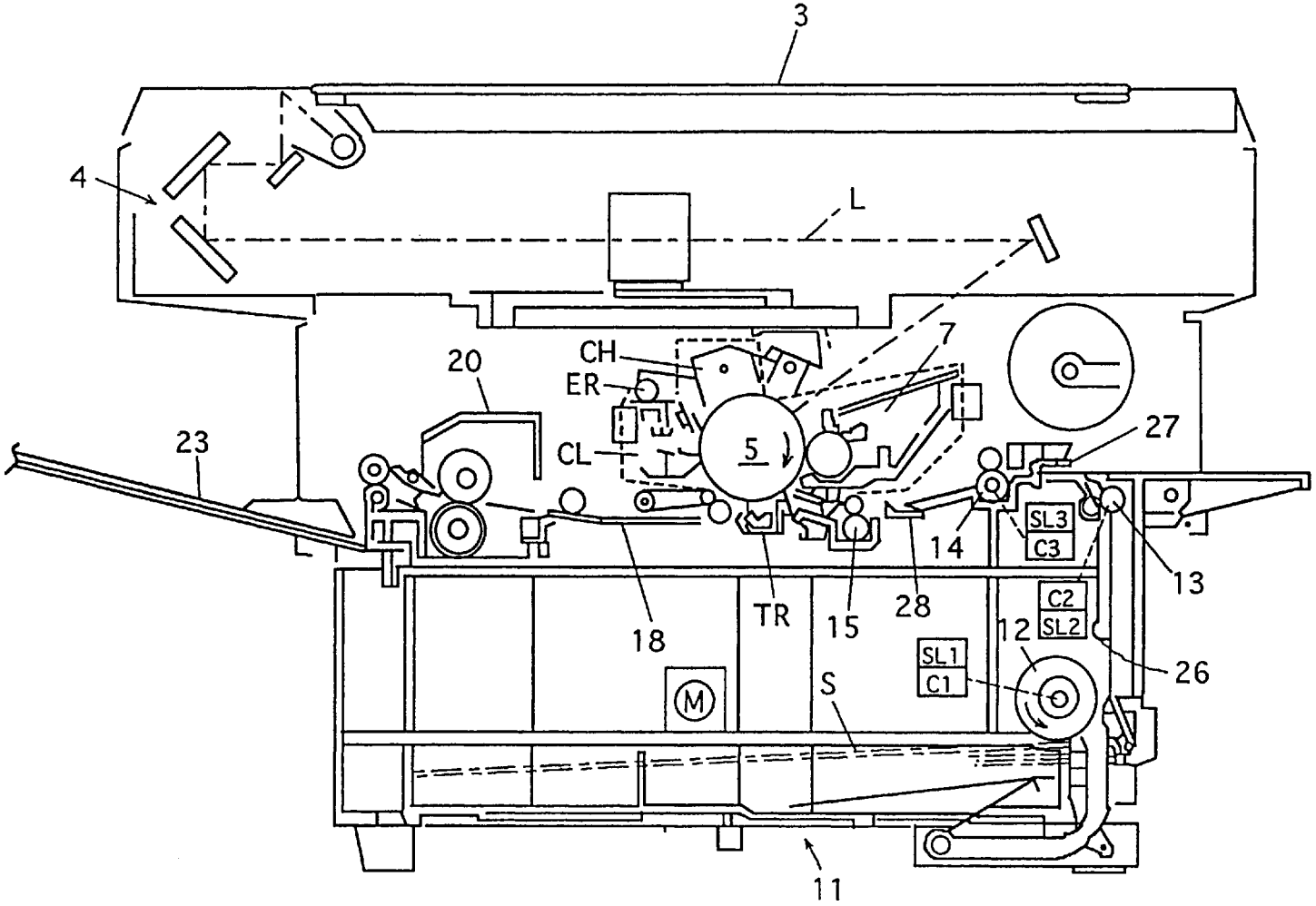
FIG. 1 schematically shows an internal mechanism of a first copying machine.
Figure 2:
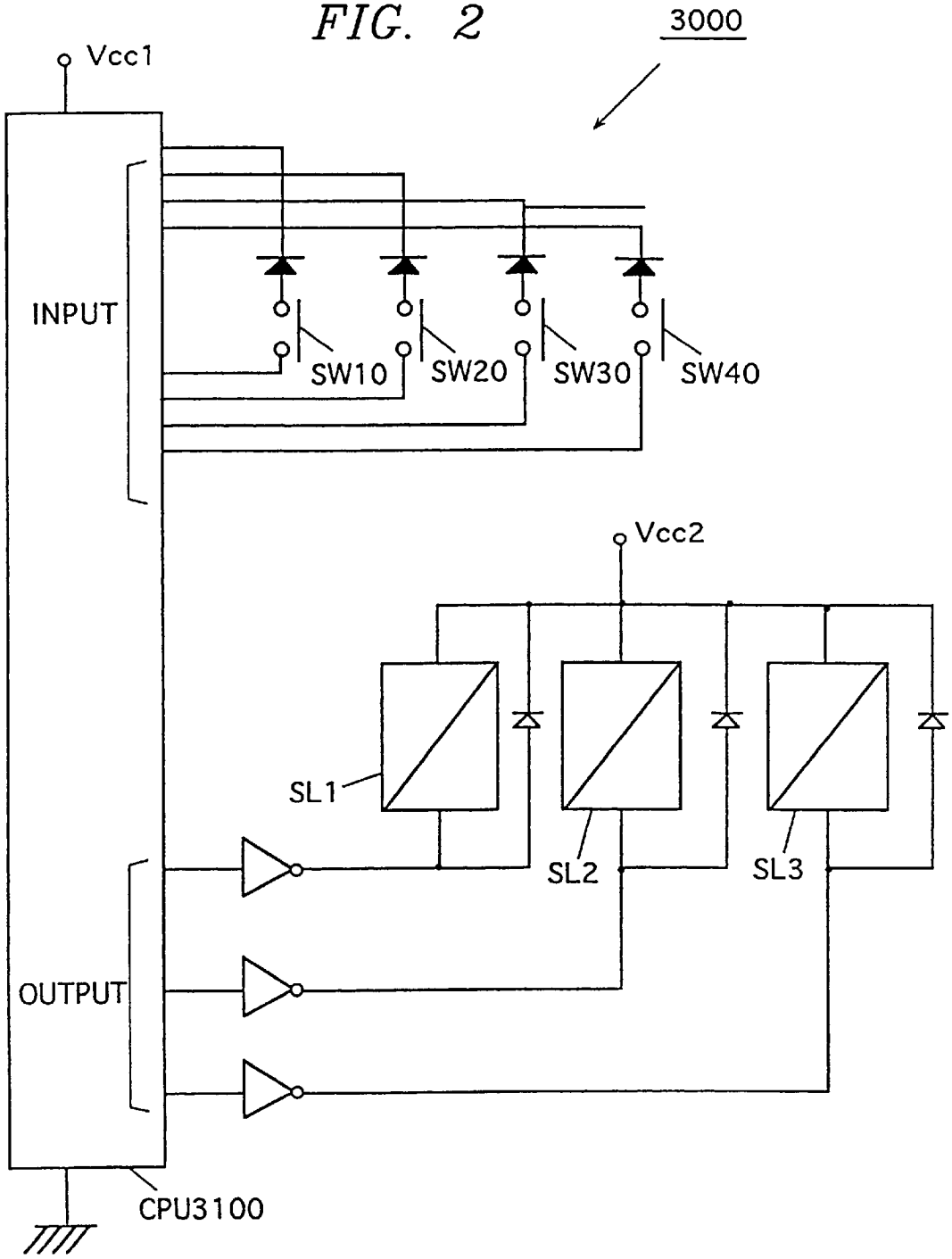
FIG. 2 is a block diagram showing a portion of a control circuitry of the copying machine.

FIG. 1 schematically shows a mechanism of the copying machine, and FIG. 2 shows signals, which are used for transportation of sheets, sent to and from a central part CPU3100 of a controller 3000 in the copying machine. The central part CPU3100 comprises a microcomputer as a major component which includes a center processing unit, a read only memory (ROM) and a random access memory (RAM).

The illustrated copying machine performs an electrophotographic image formation. More specifically, an original set on a glass plate 3 is exposed and scanned by a scanning optical system 4. Thereby, reflected light L in a slit form reflected by the original forms an image on a surface of a photosensitive drum 5 which has been electrically and uniformly charged by a charger CH, so that an electrostatic latent image corresponding to the reflected light L is formed on the surface of the drum 5. The latent image is developed with toner by a developing device 7 into a visible image, which is transferred by a transferring device TR onto a sheet. The sheet bearing the image transferred onto the same is transported along a transport guide plate 18 to a fixing device 20, and the image fixing processing is effected by thermal compression bonding. Thereafter, the sheet is discharged to an external tray 23. Toner remaining on the drum after the transference is removed by a cleaning device CL, and residual electric charges are erased by an eraser ER.

The sheets S are accommodated in and are fed from a sheet cassette 11 which is removably provided at a lower portion of the machine. A feed roller 12 confronting the cassette 11 is coupled to a drive system including an electric motor M via a clutch C1. The clutch C1 includes a portion which is selectively engaged with and disengaged from the driving system in accordance with turning on and off of a solenoid SL1, and a one-way clutch portion. When the solenoid SL1 is turned on, it transmits a power of the driving system to the feed roller 12 to rotate the same. When the solenoid SL1 is turned off, the power is interrupted, so that the roller 12 can freely rotate in a sheet feeding direction.

Above the feed roller 12 and along a sheet transporting path to a transferring position, there are sequentially disposed a sheet feed sensor 26, a transporting roller pair 13, a sheet passage sensor 27, an intermediate roller pair 14, a before-timing-roller sensor 28 and a timing roller pair 15. The transporting roller pair 13 has rollers, one of which is coupled to the driving system described above via a clutch C2, which has the same structure as the clutch C1 and is operated by a solenoid SL2. The intermediate roller pair 14 has rollers, one of which is coupled to the driving system described above via a clutch C3, which has the same structure as the clutch C1 and is operated by a solenoid SL3. The solenoids SL1, SL2 and SL3 are turned on and off based on instructions sent from the CPU 3100.

The sheets S accommodated in the sheet cassette 11, which is removably disposed at the lower portion of the machine, are fed from the sheet cassette 11 as will be described later, and are transported to the transferring position, i.e., the position at which the toner image on the photosensitive drum 5 is transferred onto the sheet, at a predetermined timing synchronized with a forward end of the image on the photosensitive drum 5.

First, the solenoid SL1 (FIG. 2) is turned on in response to a signal sent from the CPU 31, and thereby the feed roller 12 starts to rotate. The feed roller 12 which rotates counterclockwise in FIG. 1 repetitively feeds the uppermost sheet S in the sheet cassette 11. Then, the fed sheet S is transported upwardly in the figure to the transporting roller pair 13, and then is turned and fed leftwardly by the transporting roller pair 13 which is driven owing to turned-on of the solenoid SL2.

After the initiative in transporting the sheet changes from the feed roller 12 to the transporting roller pair 13, the solenoid SL1 is turned off, and the feed roller 12 is not driven by the drive system. Thus, the one-way clutch allows free rotation of the roller 12.

The sheet fed leftward by the transporting roller pair 13 reaches the intermediate roller pair 14, and then is further transported by the intermediate roller pair 14 which rotates in response to turn-on state of the solenoid SL3. When the leading edge of the sheet reaches the timing roller pair 15, the sheet is temporarily stopped there, and then will be fed to the transferring position by the timing roller pair 15 at the predetermined timing described before. After the initiative in transporting the sheet changes from the transporting roller pair 13 to the intermediate roller pair 14, the solenoid SL2 is turned off, so that the transporting roller pair 13 is not driven by the drive system. Thus, the one-way clutch allows free rotation of the transporting roller pair 13.

The sheet feed sensor 26, which is disposed immediately downstream of the feed roller 12, detects the sheet fed from the sheet cassette 11 by the feed roller 12. The passage sensor 27, which is disposed between the transporting roller pair 13 and the intermediate roller pair 14, detects the sheet which passed the transporting roller pair 13. The before-timing-roller sensor 28, which is disposed immediately upstream of the timing roller pair 15, detects the sheet which passed the intermediate roller pair 14 and has reached a position immediately before the timing roller 15. Detection signals from these sensors are sent to the CPU 3100.

Signals are also supplied to CPU3100 from switches SW10–SW40 shown in FIG. 2. The switch SW10 is a contact of the feed sensor 26. The switch SW20 is a "PRINT" key, i.e., manual key switch which is provided on an operation panel 50 of the copying machine shown in FIG. 7 for instructing start of the copying operation. The switch SW30 is a correction switch which is activated, for example, by the service man who performed maintenance such as cleaning of the feed roller 12. The switch SW40 is also adapted to be actuated, for example, by the service man after replacement of the feed roller 12. In the copying machine, the solenoid SL1 and others are controlled to be turned on and off as shown in flowcharts of FIGS. 3–6 based on input signals coming from these switches, whereby the sheet feeding operation is optimally controlled.

Sheet Control of Copying Machine

Figure 8:
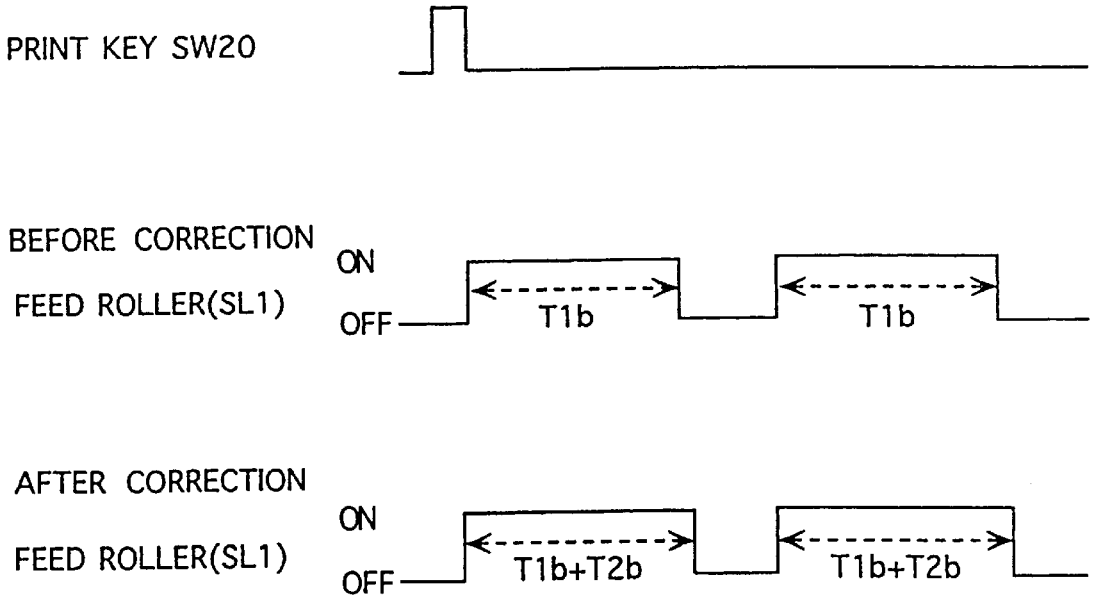
FIG. 8 is a time chart showing turn-on periods of solenoid SL1 before and after correction of a timer T1*b* in the copying machine.

The sheet feed control of the copying machine will be described below in accordance with the flowcharts shown in FIGS. 3–6 and with reference to FIG. 8.

Figure 3:
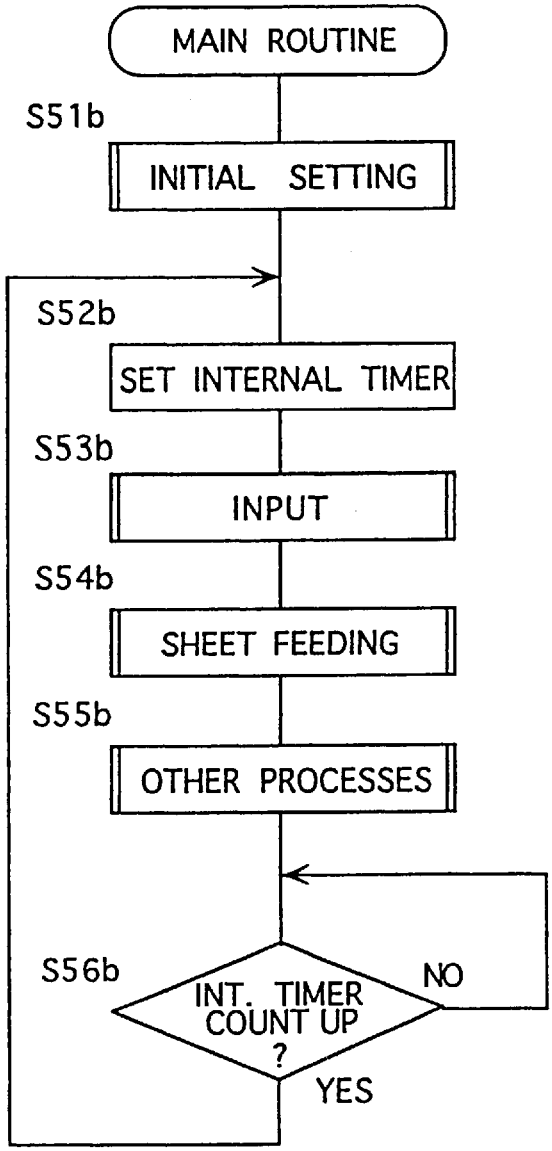
FIG. 3 is a flowchart showing a main routine of a process in CPU 3100 in FIG. 2.

Main Routine (see FIG. 3)

The CPU 3100 contains a control program shown in FIG. 3.

Upon turn-on of the power, initial setting is first carried out (S51*b*). At a subsequent step S52*b*, the internal timer for setting a cycle time of the control program is set and starts, and then, respective processes at steps S53*b* to S55*b* are repetitively carried out after every elapsing of the set time of the internal timer (S56*b*). The steps 53*b* and 54*b* will be described later. The step S55*b* totally represents processes other than the processes at the steps S53*b* and S54*b* carried out by the CPU 3100. The processes at the step S55*b* do not directly concern with the instant invention, and thus will not be described below.

Figure 4:
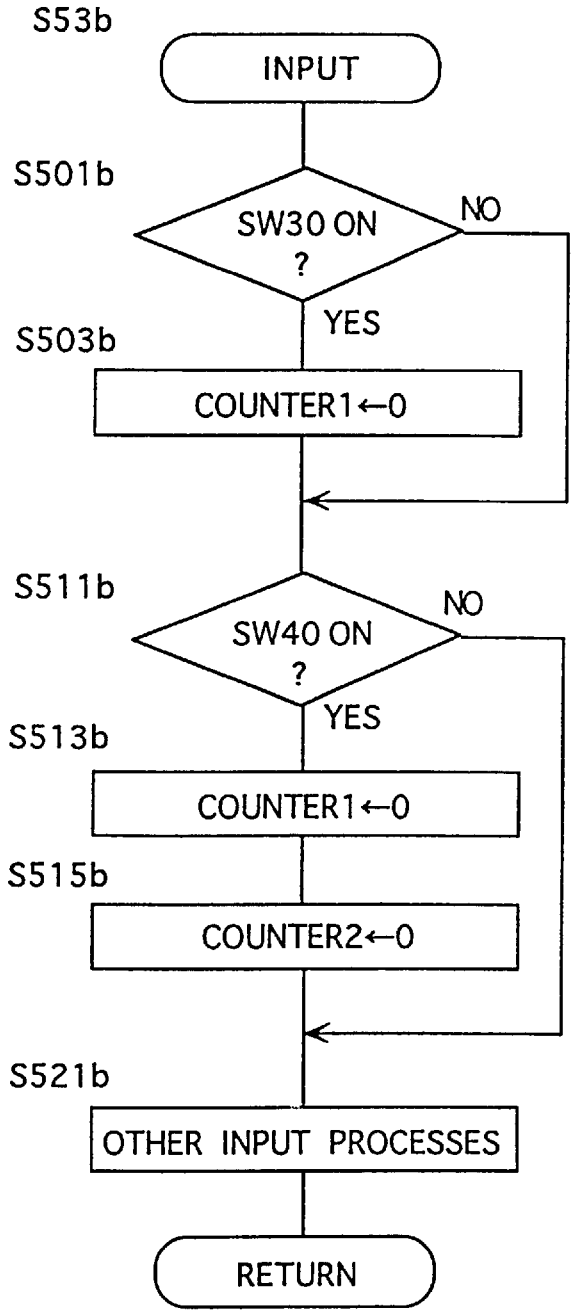
FIG. 4 is a flowchart showing a process at step S53*b* in FIG. 3.

Input Process (see FIG. 4)

When the service man or the like carries out the maintenance such as cleaning of the feed roller 12 and actuates the correction reset switch SW30 (S501*b*: YES), the counter 1 is cleared and set to 0 (S503*b*). When the service man or the like replaces the feed roller 12 and actuates the switch SW40 (S511*b*: YES), the counters 1 and 2 are cleared and set to 0 (S513*b*, S515*b*).

A step S521*b* represents processes carried out in response to inputs other than the foregoing.

Figure 5:
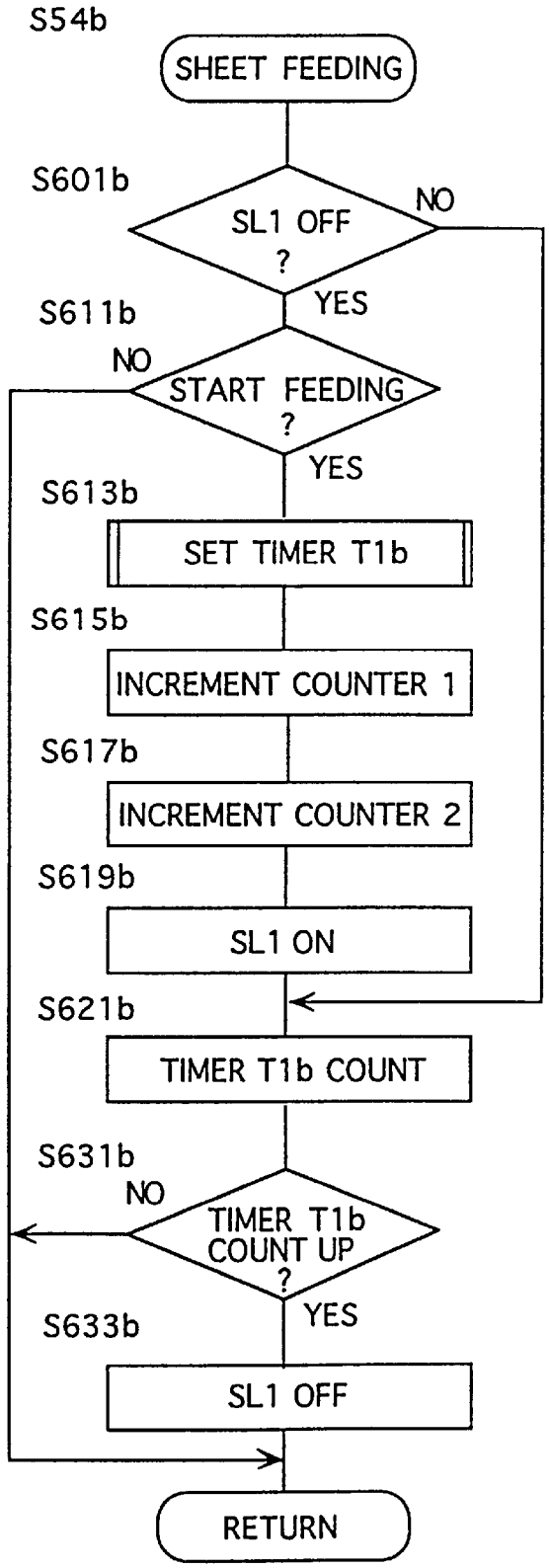
FIG. 5 is a flowchart showing a process at step S54*b* in FIG. 3.

Sheet Feeding Process (see FIG. 5)

When the solenoid SL1 is in the off state, i.e., the feed roller 12 is not driven (S601*b*: YES), and the start of the sheet feeding is instructed for example by the actuation of the "PRINT" key SW20 (S611*b*: YES), the timer T1*b* is set (S613*b*). The value of the timer T1*b* is corrected based on the values of the counters 1 and 2 which will be described below.

The counters 1 and 2 are incremented (S615*b*, S617*b*). The counter 1 represents the total number of sheets fed after the maintenance. The counter 2 represents the number of sheets fed after the replacement of the feed roller 12.

The solenoid SL1 is turned on (S619*b*) to start rotation of the feed roller 12.

At step S621*b*, the timer T1*b* performs the counting.

When the timer T1*b* counts up thereafter (S631*b*: YES), the solenoid SL1 is turned off (S633*b*) and the driving of the feed roller 12 is stopped. Thus, the timer T1*b* controls the timing of turn-off of the solenoid SL1, i.e., timing of stop of the driving of the feed roller 12. The time set in the timer T1*b* is enough to allow the leading edge of the sheet driven by the feed roller 12 to be pinched at the nip of the transporting roller pair 13, and is corrected as follows in accordance with the values of the counters 1 and 2 by the setting process of the timer T1*b* (S613*b*).

Figure 6:
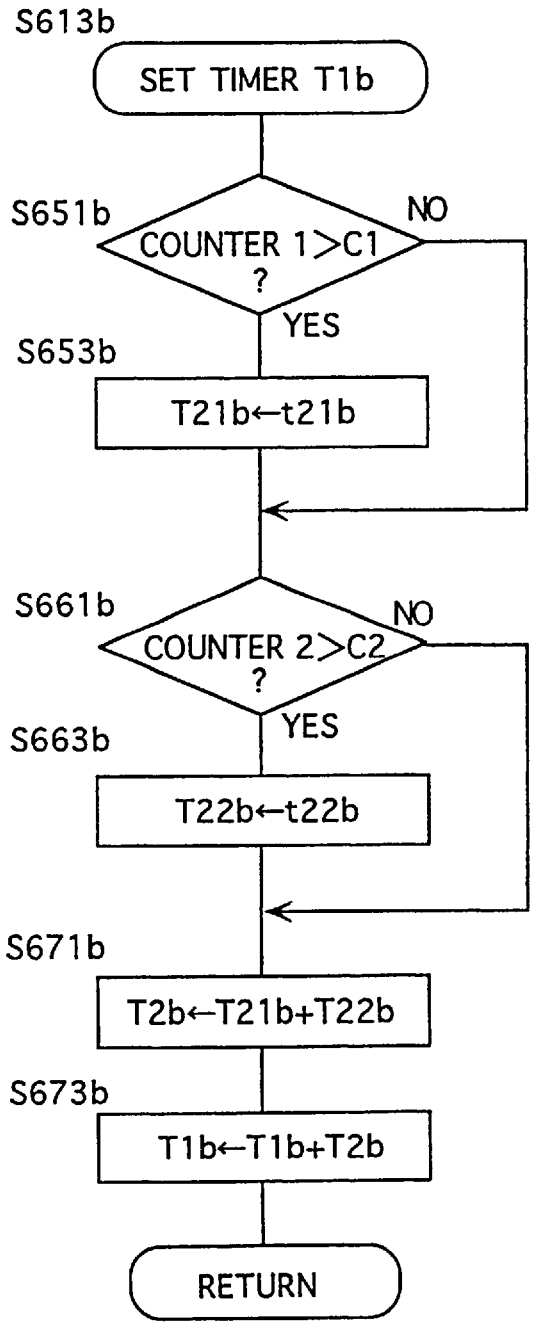
FIG. 6 is a flowchart showing a process at step S613*b* in FIG. 5.
Figure 7:
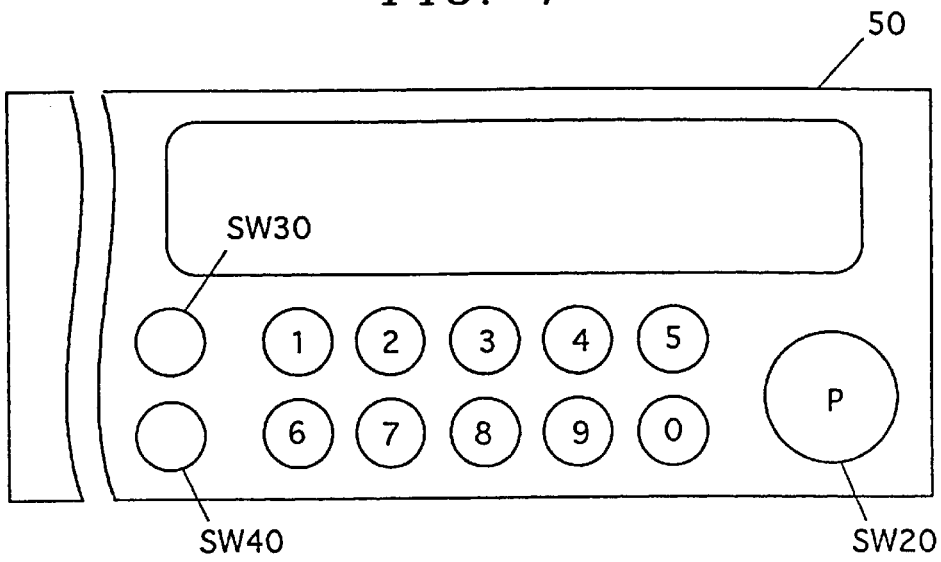
FIG. 7 shows a portion of an operation panel of the copying machine.

Setting Process of Timer T1*b* (see FIG. 6)

When the count of the counter 1 exceeds a correction reference number C1 (S651*b*: YES), t21*b* is substituted for T21*b* (S653*b*), which is a correction value for the counter 1.

When the count of the counter 2 exceeds a correction reference number C2 (S661*b*: YES), t22*b* is substituted for T22*b* (S663*b*), which is a correction value for the counter 2.

At step S671*b*, the sum (T21*b*+T22*b*) of the above values T21*b* and T22*b* is used as the total correction value T2*b* for the counters 1 and 2.

At step S673*b*, a value of the ordinary value T1*b* of the timer T1*b* plus above total correction value T2*b* is substituted for the value of the timer T1*b*.

As a result of correction described above, the value of T1*b* before the correction changes to T1*b*+T2*b* after the correction while the solenoid SL1 is in the on state. Here, the period after the correction means the period after the fed sheet number after the maintenance exceeds C1 or after the fed sheet number exceeds C2 after replacement of the feed roller 12.

According to the method and device for transporting the sheets in the copying machine, the time period of rotation of the roller is extended in accordance with the total number of sheets which were transported after the maintenance. Therefore, the actual transport distance of the sheet transported by the roller is substantially equal to the constant distance , by which the sheet is transported when there is neither wear of the roller nor adhesion of paper powder, regardless of conditions such as wear of the roller and adhesion of paper powder, so that the sheet jamming is prevented.

Although the invention has been described in connection with the copying machines, the invention can be applied to other image forming apparatuses such as a printer.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A sheet transporting apparatus comprising:

a sheet transporting device for sequentially transporting sheets;

a control device for operating said sheet transporting device for a predetermined time so as to transport a sheet to a predetermined position;

a counting device for providing a count value indicating a number of sheets which have been transported by said sheet transporting device; and a correcting device for correcting said predetermined time based on the count value.

2. A sheet transporting apparatus in accordance with claim 1, wherein said correcting device is operable to extend said predetermined time when the count value exceeds a predetermined value.

3. A sheet transporting apparatus in accordance with claim 1, wherein said counting device includes a first counter which is suitable for counting a total number of sheets which have been transported after a maintenance of said sheet transporting device and a second counter which is suitable for counting a total number of sheets which have been transported after said sheet transporting device has been installed as a replacement.

4. A sheet transporting apparatus in accordance with claim 3, further comprising a first reset switch for resetting said first counter when maintenance of said sheet transporting device is performed, and a second reset switch for resetting said second counter when said sheet transporting device is installed as a replacement.

5. A sheet transporting apparatus in accordance with claim 1, wherein said sheet transporting device transports said sheets sequentially from a stack of sheets.

6. A sheet feeding apparatus comprising:

a first roller which sequentially feeds sheets in a sheet travel direction;

a second roller which sequentially feeds sheets and is arranged downstream, in the sheet travel direction, from said first roller;

a counting device which provides a first count value indicating a number of sheets fed by said first roller;

a controller which operates said first roller for a predetermined time so as to feed a sheet from said first roller toward said second roller and which corrects said predetermined time based on said count value.

7. A sheet feeding apparatus in accordance with claim 6, wherein said controller extends said predetermined time when the count value exceeds a predetermined value.

8. A sheet feeding apparatus in accordance with claim 6, wherein said counting device includes a first counter which is suitable for counting a total number of sheets fed by said first roller after a maintenance of said first roller and a second counter which is suitable for counting a total number of sheets fed by said first roller after said first roller is installed as a replacement.

9. A sheet feeding apparatus in accordance with claim 8, further comprising a first reset switch for resetting said first counter when maintenance of said first roller is performed, and a second reset switch for resetting said second counter when said first roller is installed as a replacement.

10. A sheet feeding apparatus in accordance with claim 6, wherein said first roller is a feed roller for sequentially feeding sheets from a stack of sheets.

11. A method of sequentially transporting sheets, said method comprising the steps of:

operating a sheet transporting means for a predetermined time to thereby transport a sheet to a predetermined position;

counting a number of sheets transported by said sheet transporting means; and correcting said predetermined time based on the thus counted number of sheets.

12. A method in accordance with claim 11, wherein said step of correcting comprises extending said predetermined time when said counted number of sheets exceeds a predetermined number.

13. A method in accordance with claim 11, wherein said step of counting comprises counting a total number of sheets transported after maintenance of said sheet transporting means and counting a total number of sheets after replacement of said sheet transporting means.

* * * * *